US006048120A

United States Patent [19]

Kerr

[11] Patent Number: 6,048,120

[45] Date of Patent: Apr. 11, 2000

[54] VACUUM IMAGING DRUM WITH ANGLED VACUUM HOLES

[75] Inventor: Roger S. Kerr, Brockport, N.Y.

[73] Assignee: Eastman Kodak Company, Rochester, N.Y.

[21] Appl. No.: 09/358,833

[22] Filed: Jul. 22, 1999

[51] Int. Cl.[7] ..... B41J 11/057

[52] U.S. Cl. ..... 400/662; 400/627

[58] Field of Search ..... 101/389.1, 232; 271/276, 196; 400/624, 627, 662

[56] References Cited

U.S. PATENT DOCUMENTS

| | | | |
|---|---|---|---|
| 4,403,847 | 9/1983 | Chrestensen | 271/196 |
| 4,660,825 | 4/1987 | Umezawa | 271/276 |
| 4,852,488 | 8/1989 | Abendroth et al. | 101/246 |
| 5,159,352 | 10/1992 | Ferla et al. | 346/108 |
| 5,186,107 | 2/1993 | Wieland | 101/409 |
| 5,268,708 | 12/1993 | Harshbarger et al. | 346/134 |
| 5,276,464 | 1/1994 | Kerr et al. | 271/196 |
| 5,520,382 | 5/1996 | Nakajima | 271/188 |
| 5,913,268 | 7/1999 | Jackson et al. | 101/232 |

FOREIGN PATENT DOCUMENTS

| | | | |
|---|---|---|---|
| 1029990 | 6/1953 | France | 271/74 |
| 2109237 | 2/1971 | Germany | 271/196 |

*Primary Examiner*—John S. Hilten
*Assistant Examiner*—Daniel J. Colilla
*Attorney, Agent, or Firm*—Nelson Adrian Blish

[57] ABSTRACT

An image processing apparatus (10) comprises a vacuum imaging drum (300) for holding thermal print media (32) and dye donor material (36), in registration with the thermal print media (32), on a surface of the vacuum imaging drum (300). A printhead (500) prints information to the thermal print media (32) as the printhead is moved parallel to the surface (305) of the vacuum imaging drum (300). Angled vacuum holes (306) connect the surface (305) and an interior (304) of the vacuum imaging drum (300) to maintain the thermal print media (32) on the surface. The angled vacuum holes (306) are at an acute angle to the surface (305) of the vacuum imaging drum (300).

9 Claims, 6 Drawing Sheets

VACUUM IMAGING DRUM WITH ANGLED VACUUM HOLES

FIELD OF THE INVENTION

This invention relates to an image processing apparatus of the lathe bed scanning type and more specifically to angled vacuum holes on a surface of a vacuum imaging drum for holding sheets of media on the surface the drum as the drum rotates at high speeds.

BACKGROUND OF THE INVENTION

Pre-press color proofing is a procedure used by the printing industry for creating representative images of printed material without the high cost and time required to actually produce printing plates and set up a high-speed, high-volume, printing press to produce a single example of an intended image. These intended images may require several corrections and may need to be reproduced several times to satisfy customers requirements. By utilizing pre-press color proofing time and money can be saved.

One such commercially available image processing apparatus, disclosed in commonly assigned U.S. Pat. No. 5,268,708, describes image processing apparatus having half-tone color proofing capabilities. This image processing apparatus is arranged to form an intended image on a sheet of thermal print media by transferring dye from a sheet of dye donor material to the thermal print media by applying a sufficient amount of thermal energy to the dye donor material to form an intended image. This image processing apparatus is comprised of a material supply assembly or carousel; lathe bed scanning subsystem, which includes a lathe bed scanning frame, translation drive, translation stage member, and printhead; vacuum imaging drum; and thermal print media and dye donor material exit transports.

The operation of the image processing apparatus comprises metering a length of the thermal print media, in roll form, from the material assembly or carousel. The thermal print media is cut into sheets, transported to the vacuum imaging drum, registered, wrapped around, and secured onto the vacuum imaging drum. A length of dye donor material, in roll form, is metered out of the material supply assembly or carousel, and cut into sheets. The dye donor material is transported to and wrapped around the vacuum imaging drum, such that it is superposed in the registration with the thermal print media.

After the dye donor material is secured to the periphery of the vacuum imaging drum, the scanning subsystem or write engine writes an image on the thermal print media as the thermal print media and the dye donor material on the spinning vacuum imaging drum is rotated past the printhead. The translation drive traverses the printhead and translation stage member axially along the vacuum imaging drum, in coordinated motion with the rotating vacuum imaging drum to produce the intended image on the thermal print media.

After the intended image has been written on the thermal print media, the dye donor material is removed from the vacuum imaging drum without disturbing the thermal print media that is beneath it. The dye donor material is transported out of the image processing apparatus by the dye donor material exit transport. Additional sheets of dye donor material are sequentially superposed with the thermal print media on the vacuum imaging drum, and imaged onto the thermal print media as described above until the intended image is completed. The completed image on the thermal print media is unloaded from the vacuum imaging drum and transported to an external holding tray on the image processing apparatus by the receiver sheet material exit transport.

The vacuum imaging drum is cylindrical in shape and includes a hollowed-out interior portion. A plurality of holes extending through the drums permit a vacuum to be applied from the interior of the vacuum imaging drum for supporting and maintaining the position of the thermal print media and dye donor material as the vacuum imaging drum rotates.

Although the operation of prior art image processing apparatus is satisfactory, it is not without drawbacks. The donor and receiver media must be held tightly against the surface of the vacuum imaging drum to prevent irregular surface conditions caused by factors such as folds, creases, wrinkles, or trapped air. Such irregular surface conditions could adversely affect the imaging process, or cause the media to fly-off at high drum speeds causing damage to the image processing apparatus. To achieve a flat surface, considerable vacuum force is exerted. A solution that would decrease or eliminate folds, creases, wrinkles, or trapped air would be advantageous and would allow higher drum speeds which would increase throughput of the imaging apparatus.

To prevent folds, creases, wrinkles, or trapped air when the sheets are wrapped around a vacuum drum, conventional methods include using clamps as a supplement to vacuum. For example, clamps used with a vacuum imaging drum are disclosed in U.S. Pat. No. 5,159,352 (Ferla et al.) and U.S. Pat. No. 4,660,825 (Umezawa). However, such solutions are mechanically complex. Moreover, even slight protrusion of a clamp from the surface circumference of the drum is prohibitive at high speeds, for example, 600 RPM and higher, and measures must then be taken to prevent mechanical contact with the printhead.

Other approaches for stretching a sheet on a drum include those used with printing press paper transfer mechanisms. U.S. Pat. No. 4,852,488 (Abendroth et al.) discloses the use of sucker fingers inside a sheet transfer drum. These sucker fingers are disposed within slots on the surface of the drum. The fingers grab the sheet at discrete points, then provide stretching action as the fingers are moved diagonally within the slots. U.S. Pat. No. 5,186,107 (Wieland) discloses suction elements that perform a similar stretching function on a press transfer drum. The suction elements are at extreme ends of the sheet in diagonal slots so that the stretching action pulls the media outward from its center. Such solutions are mechanically complex, however, and would be likely to distort the media used in an image processing apparatus.

Mechanical clamps, fingers, slots, or other structures affect the weight distribution of drum components and any imbalance could easily cause the drum to go out of round when rotating at high speeds. There is a need for providing increased suction and stretching force for donor and receiver media loaded onto a vacuum imaging drum without increasing the drum vacuum or adding unnecessary additional mechanical components.

SUMMARY OF THE INVENTION

According to one feature of the present invention an image processing apparatus comprises a vacuum imaging drum for holding thermal print media and dye donor material, in registration with the thermal print media, on a surface of the vacuum imaging drum. A printhead prints information to the thermal print media as the printhead is moved parallel to the surface of the vacuum imaging drum. The vacuum imaging drum has vacuum holes connecting the surface and an interior of the vacuum imaging drum to maintain the thermal print media on the surface, wherein the vacuum holes are at an acute angle to the surface of the vacuum imaging drum.

An advantage of the present invention is that the angled vacuum holes smooth out folds, creases, wrinkles, and reduce trapped air in the thermal print media. An additional advantage of the present invention is that it adds no components to the vacuum imaging drum. A further advantage is that changes to the weight distribution of the vacuum imaging drum are negligible.

The invention and its objects and advantages will become more apparent in view of the detailed description of the preferred embodiment presented below.

DETAILED DESCRIPTION OF THE INVENTION

Figure 1:
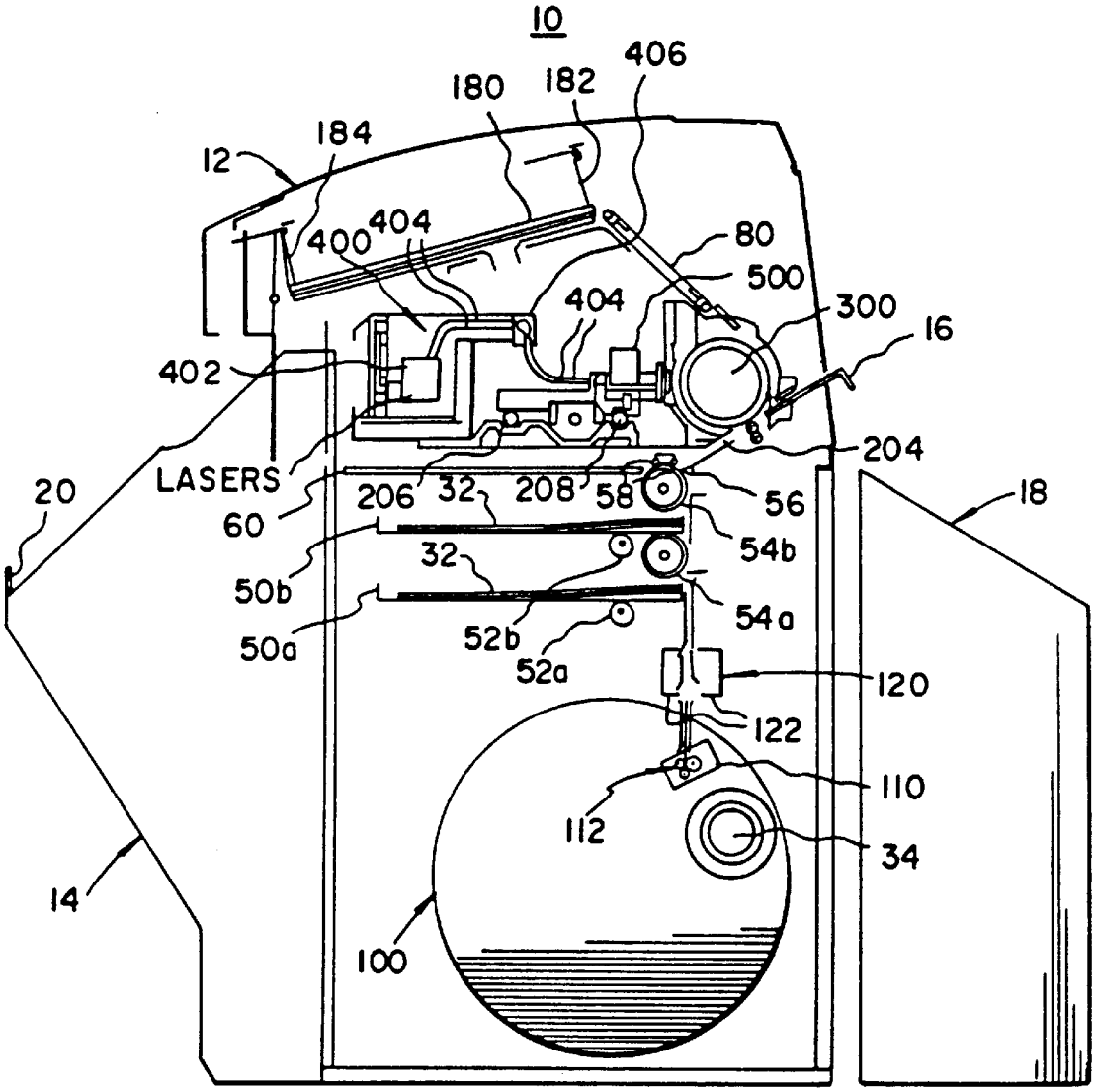
FIG. 1 is a side view in vertical cross section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of image processor housing 12 permitting access to two sheet material trays, a lower sheet material tray 50*a* and an upper sheet material tray 50*b*, that are positioned in the interior portion of image processor housing 12 for supporting thermal print media 32, thereon. Only one sheet material tray dispenses thermal print media 32 to create an intended image thereon; the alternate sheet material tray either holds an alternative type of thermal print media 32 or functions as a back up sheet material tray. In this regard, lower sheet material tray 50*a* includes a lower media lift cam 52*a* for lifting lower sheet material tray 50*a* and ultimately thermal print media 32, upwardly toward a rotatable, lower media roller 54*a* and toward a second rotatable, upper media roller 54*b* which, when both are rotated, permits thermal print media 32 to be pulled upwardly towards a media guide 56. Upper sheet material tray 50*b* includes an upper media lift cam 52*b* for lifting upper sheet material tray 50*b* and ultimately thermal print media 32 towards upper media roller 54*b* which directs it towards media guide 56.

Movable media guide 56 directs the thermal print media 32 under a pair of media guide rollers 58 which engages the thermal print media 32 for assisting upper media roller 54*b* in directing it onto a media staging tray 60. Media guide 56 is attached and hinged to a lathe bed scanning frame 202 at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving thermal print media 32 resting on media staging tray 60 under a pair of media guide rollers 58, upwardly through an entrance passageway 204 and around a rotatable vacuum imaging drum 300.

A roll media of donor roll material 34 is connected to a media carousel 100 in a lower portion of image processor housing 12. Four rolls of roll media are used, but only one is shown for clarity. Each roll media includes a donor roll material 34 of a different color, typically black, yellow, magenta and cyan. Donor roll material is cut into donor sheet material 36 and passed to a vacuum imaging drum 300. A media drive mechanism 110 is attached to each roll media of donor roll material 34, and includes three media drive rollers 112 through which the donor roll material 34 of interest is metered upwardly into a media knife assembly 120. After the donor roll material 34 reaches a predetermined position, media drive rollers 112 cease driving donor roll material 34 and two media knife blades 122 positioned at the bottom portion of the media knife assembly 120 cut the donor roll material 34 into donor sheet materials 36 (not shown). Lower media roller 54*a* and upper media roller 54*b* along with media guide 56 then pass donor sheet material 36 onto media staging tray 60 and ultimately to vacuum imaging drum 300 and in registration with the thermal print media 32 using the same process as described above for passing thermal print media 32 onto vacuum imaging drum 300. Donor sheet material 36 now rests atop thermal print media 32 with a narrow space between the two created by microbeads imbedded in the surface of thermal print media 32.

A laser assembly 400 includes a quantity of laser diodes 402 in its interior, laser diodes 402 are connected via fiber optic cables 404 to a distribution block 406 and ultimately to a printhead 500. Printhead 500 directs thermal energy received from laser diodes 402 causing donor sheet material 36 to pass the desired color across the gap to thermal print media 32. Printhead 500 is attached to a lead screw 250 via a lead screw drive nut 254 and a drive coupling (not shown) for permitting movement axially along the longitudinal axis of vacuum imaging drum 300 for transferring the data to create the intended image onto thermal print media 32.

For writing, vacuum imaging drum 300 rotates at a constant velocity, and printhead 500 begins at one end of thermal print media 32 and traverse the entire length of thermal print media 32 for completing the transfer process for the particular donor sheet material 36 resting on thermal print media 32. After printhead 500 has completed the transfer process, for the particular donor sheet material 36 resting on thermal print media 32 donor sheet material 36 is then removed from vacuum imaging drum 300 and transferred out image processor housing 12 via a skive or ejection chute 16. The donor sheet material 36 eventually comes to rest in a waste bin 18 for removal by the user. The above described process is then repeated for the other three rolls of roll media of donor roll materials 34.

After the colors from all four sheets of donor sheet materials 36 have been transferred and donor sheet materials 36 have been removed from vacuum imaging drum 300, thermal print media 32 is removed from vacuum imaging drum 300 and transported via a transport mechanism 80 to a color binding assembly 180. A media entrance door 182 of color binding assembly 180 is opened for permitting thermal print media 32 to enter color binding assembly 180, and shuts once thermal print media 32 comes to rest in color binding assembly 180. Color binding assembly 180 processes thermal print media 32 for further binding the transferred colors on thermal print media 32 and for sealing the microbeads thereon. After the color binding process has been completed, media exit door 184 is opened and thermal print media 32 with the intended image thereon passes out of color binding assembly 180 and image processor housing 12 and comes to rest against a media stop 20.

Figure 2:
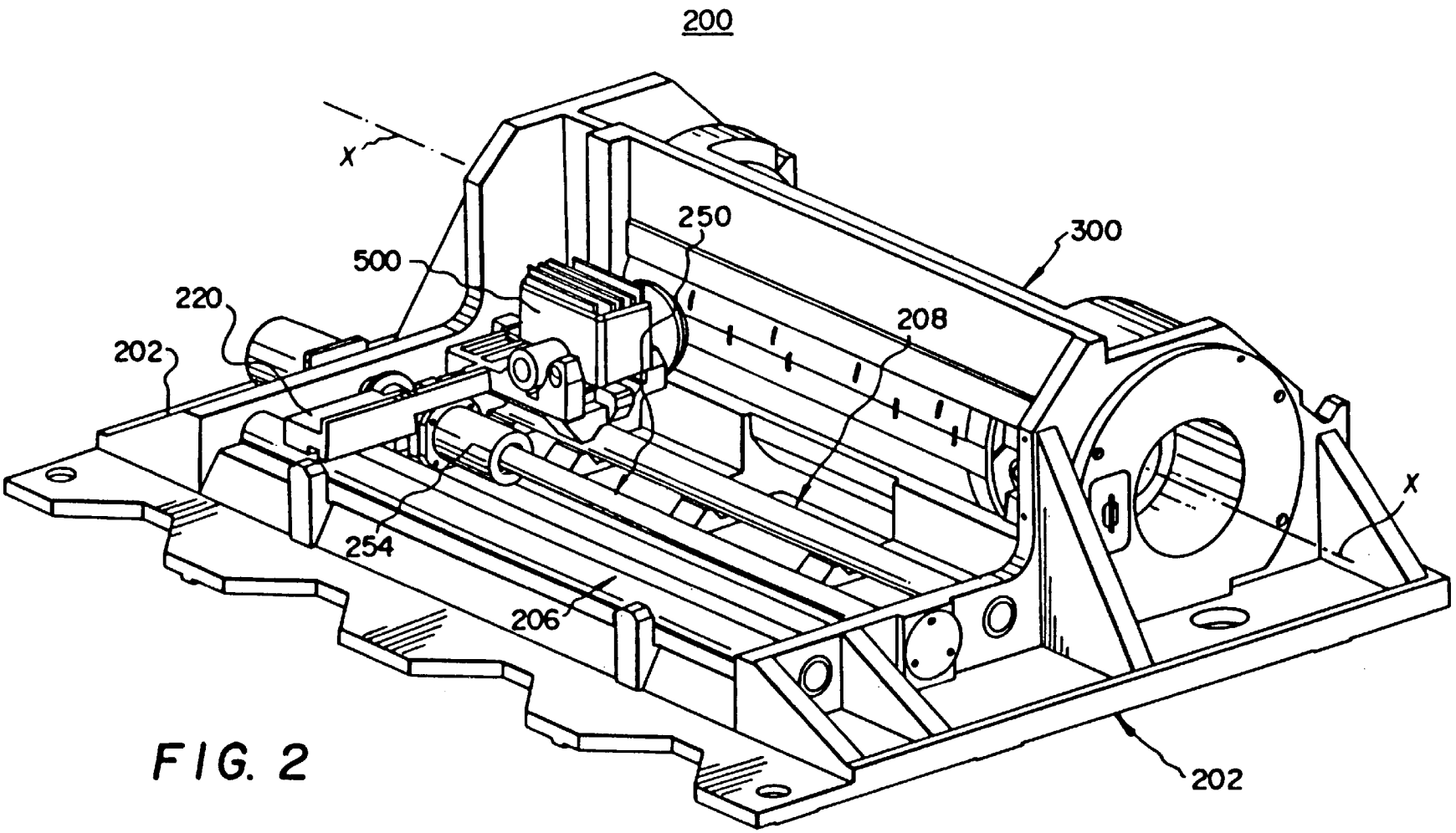
FIG. 2 is a perspective view of the lathe bed scanning subsystem or write engine of the present invention.

Referring to FIG. 2, there is illustrated a perspective view of the a lathe bed scanning subsystem 200 of image processing apparatus 10, including vacuum imaging drum 300, printhead 500 and lead screw 250 assembled in lathe bed scanning frame 202. Vacuum imaging drum 300 is mounted for rotation about an axis X in lathe bed scanning frame 202. Printhead 500 is movable with respect to vacuum imaging drum 300, and is arranged to direct a beam of light to donor sheet material 36. The beam of light from printhead 500 for each laser diode 402 (not shown in FIG. 2) is modulated individually by modulated electronic signals from image processing apparatus 10, which are representative of the shape and color of the original image, so that the color on donor sheet material 36 is heated to cause volatilization only in those areas in which its presence is required on thermal print media 32 to reconstruct the shape and color of the original image.

Printhead 500 is mounted on a movable translation stage member 220 which, in turn, is supported for low friction slidable movement on translation bearing rods 206 and 208. Translation bearing rods 206 and 208 are sufficiently rigid so as not to sag or distort as is possible between their mounting points and are arranged as parallel as possible with the axis X of the vacuum imaging drum 300 with the axis of the printhead 500 perpendicular to axis X of the vacuum imaging drum 300. A front translation bearing rod 208 locates a translation stage member 220 in the vertical and the horizontal directions with respect to axis X of vacuum imaging drum 300. A rear translation bearing rod 206 locates translation stage member 220 only with respect to rotation of translation stage member 220 about front translation bearing rod 208 so that there is no over-constraint condition of translation stage member 220 which might cause it to bind, chatter, or otherwise impart undesirable vibration or jitters to printhead 500 during the generation of an intended image.

Printhead 500 travels in a path along vacuum imaging drum 300, while being moved at a speed synchronous with vacuum imaging drum 300 rotation and proportional to the width of a writing swath (not shown). The pattern that printhead 500 transfers to the thermal print media 32 along vacuum imaging drum 300, is a helix.

Figure 3:
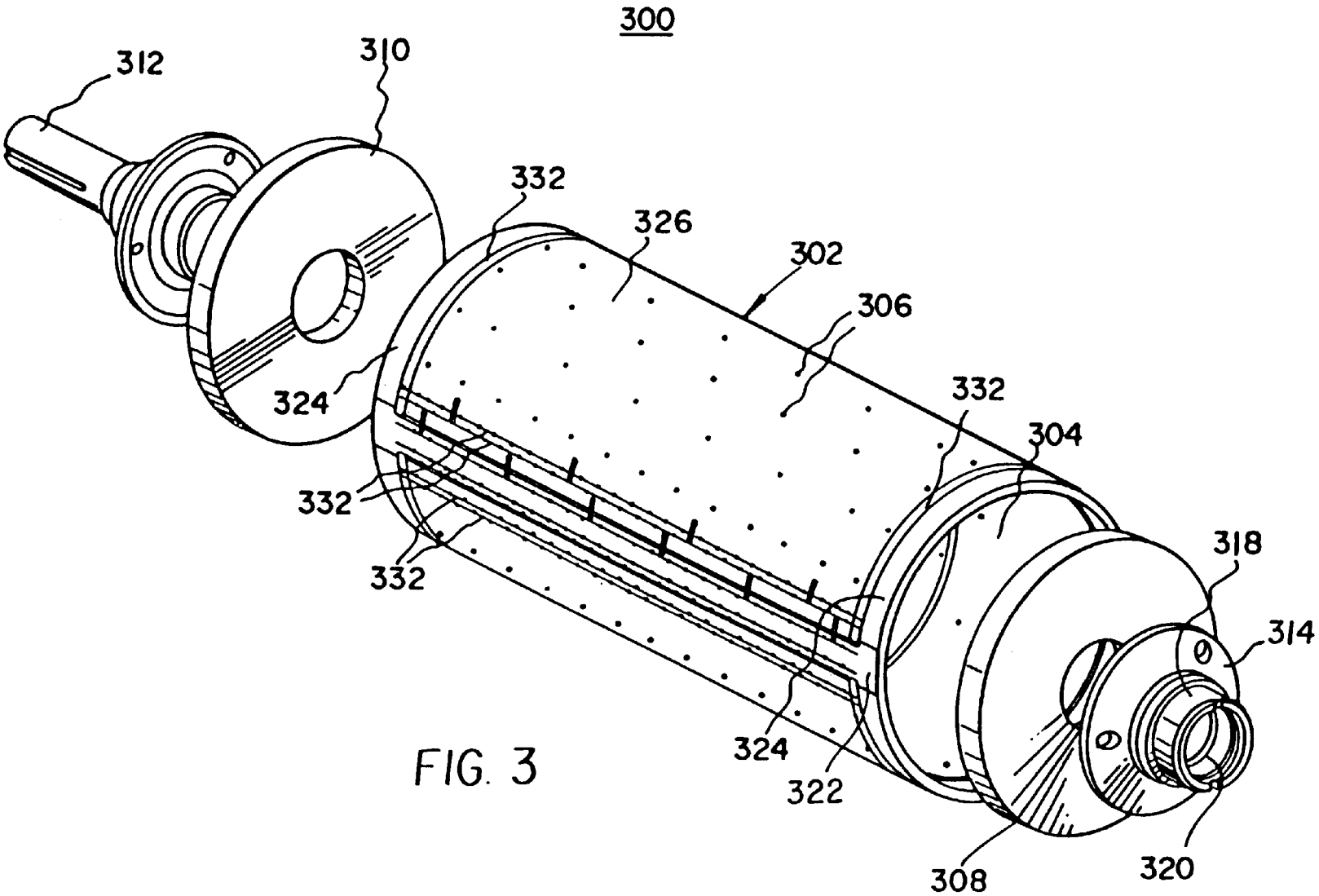
FIG. 3 is a exploded, perspective view of the vacuum imaging drum of the present invention.

Referring to FIG. 3, there is illustrated an exploded view of vacuum imaging drum 300. Vacuum imaging drum 300 has a cylindrical shaped vacuum drum housing 302 that has a hollowed-out interior portion 304, and further includes a plurality of vacuum grooves 332 and vacuum holes 306 which extend through vacuum drum housing 302 for permitting a vacuum to be applied from hollowed-out interior portion 304 of vacuum imaging drum 300 for supporting and maintaining position of thermal print media 32, and donor sheet material 36, as vacuum imaging drum 300 rotates.

The ends of vacuum imaging drum 300 are closed by a vacuum end plate 308, and a drive end plate 310. Drive end plate 310, is provided with a centrally disposed drive spindle 312 which extends outwardly therefrom. Drive spindle 312 is stepped down to receive a DC drive motor armature and mount a drum encoder.

Vacuum spindle 318 is provided with a central vacuum opening 320 that aligns with and accepts a vacuum fitting (not shown). Vacuum fitting is connected to a high-volume vacuum blower (not shown) which is capable of producing 50–60 inches of water (93.5–112.2 mm of mercury) at an air flow volume of 60–70 cfm (28.368–33.096 liters per second). This provides the vacuum to vacuum imaging drum 300 for supporting the various internal vacuum levels of vacuum imaging drum 300 required during the loading, scanning and unloading of thermal print media 32 and donor sheet materials 36 to create the intended image. With no media loaded on vacuum imaging drum 300, the internal vacuum level of vacuum imaging drum 300 is approximately 10–15 inches of water (18.7–28.05 mm mercury). With just thermal print media 32 loaded on vacuum imaging drum 300 the internal vacuum level of vacuum imaging drum 300 is approximately 20–25 inches of water (37.4–46.75 mm of mercury). This level is required such that when a donor sheet material 36 is removed, thermal print media 32 does not move. Otherwise, color to color registration would be adversely affected. With both thermal print media 32 and donor sheet material 36 completely loaded on vacuum imaging drum 300 the internal vacuum level of vacuum imaging drum 300 is approximately 50–60 inches of water (93.5–112.2 mm of mercury) in this configuration.

The outer surface of vacuum imaging drum 300 is provided with an axially extending flat 322 (shown in FIG. 4 and FIG. 5A) which extends approximately 8 degrees of the vacuum imaging drum 300 circumference. Vacuum imaging drum 300 is also provided with donor support rings 324 which form a circumferential recess 326 which extends from one side of axially extending flat 322 circumferentially around vacuum imaging drum 300 to the other side of axially extending flat 322, and from approximately one inch (25.4 mm) from one end of vacuum imaging drum 300 to approximately one inch (25.4 mm) from the other end of vacuum imaging drum 300.

Figure 5A:
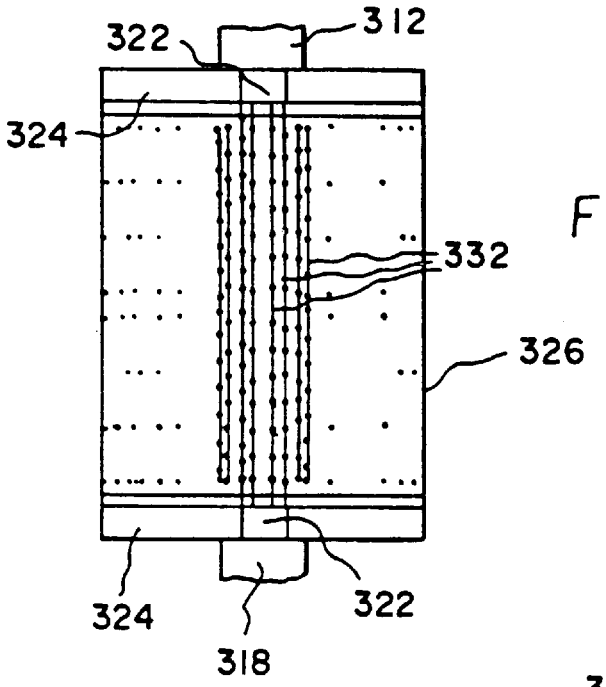
FIGS. 5A–5C are a plane views of the vacuum imaging drum showing the sequence of placement for the thermal print media and dye donor material.
Figure 5B:
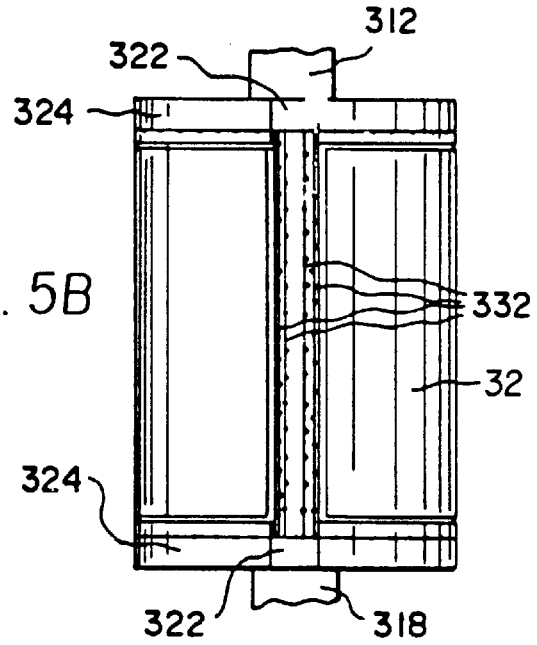
Figure 5C:
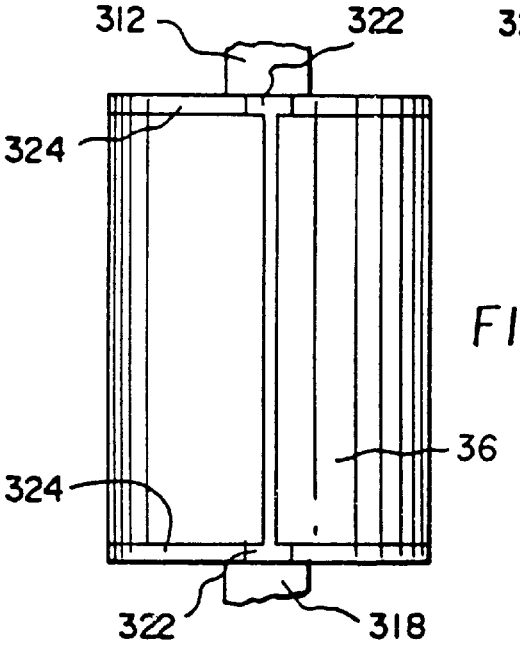

Thermal print media 32, when mounted on the vacuum imaging drum, is seated within circumferential recess 326, as shown in FIG. 5B (receiver media sheet) and FIG. 5C (donor sheet material 36 position on top of the receiver media sheet). To accommodate media sheet sizes, donor support rings 324 have a thickness substantially equal to thermal print media 32 thickness seated therebetween, which is approximately 0.004 inches (0.102 mm) in thickness. The purpose of circumferential recess 326 on vacuum imaging drum 300 surface is to eliminate any creases in donor sheet material 36, as the sheet is drawn down over thermal print media 32 during the loading of donor sheet material 36. This ensures that no folds or creases will be generated in donor sheet material 36 which could extend into the image area and adversely affect the intended image. Circumferential recess 326 also substantially reduces entrapment of air along the edge of thermal print media 32, where it is difficult for vacuum holes 306 in vacuum imaging drum 300 to assure the removal of the entrapped air. Any residual air between thermal print media 32 and donor sheet material 36, can also adversely affect the intended image.

Media contours 328 are formed in the donor support rings 324 along the edges of axially extending flat 322. Axially extending flat 322 and media contours 328 are similar, they assure that the leading and trailing ends of donor sheet material 36 are somewhat protected from the effect of increased air turbulence during the relatively high speed rotation that vacuum imaging drum 300 undergoes during the image scanning process. Thus increased air turbulence has less tendency to lift or separate the leading or trailing edges of donor sheet material 36 from vacuum imaging drum 300. In addition, axially extending flat 322 and media contours 328 ensure that the leading and trailing ends of donor sheet material 36 are recessed from the periphery of vacuum imaging drum 300. This reduces the chance that donor sheet material 36 can come in contact with other parts of image processing apparatus 10, such as printhead 500. Inadvertent contact could cause a media jam within the image processing apparatus, resulting in the possible loss of the intended image or, at worst, catastrophic damage to image processing apparatus 10 possibly damaging printhead 500.

Media contours 328 support the corners of donor sheet material 36 preventing flutes or air under the comers of donor sheet material 36. This helps to allow full contact with the surface of vacuum imaging drum 300 and minimize the tendency of the media to lift or separate from vacuum imaging drum 300 when rotating at high speeds.

FIG. 5A illustrates a plane view of the surface of vacuum imaging drum 300, prior to loading a sheet of media. FIG. 5B shows vacuum imaging drum 300 after loading a single sheet of thermal media 32. FIG. 5C shows vacuum imaging drum 300 after loading a sheet of donor sheet material 36 atop the sheet of thermal media 32.

Figure 4:
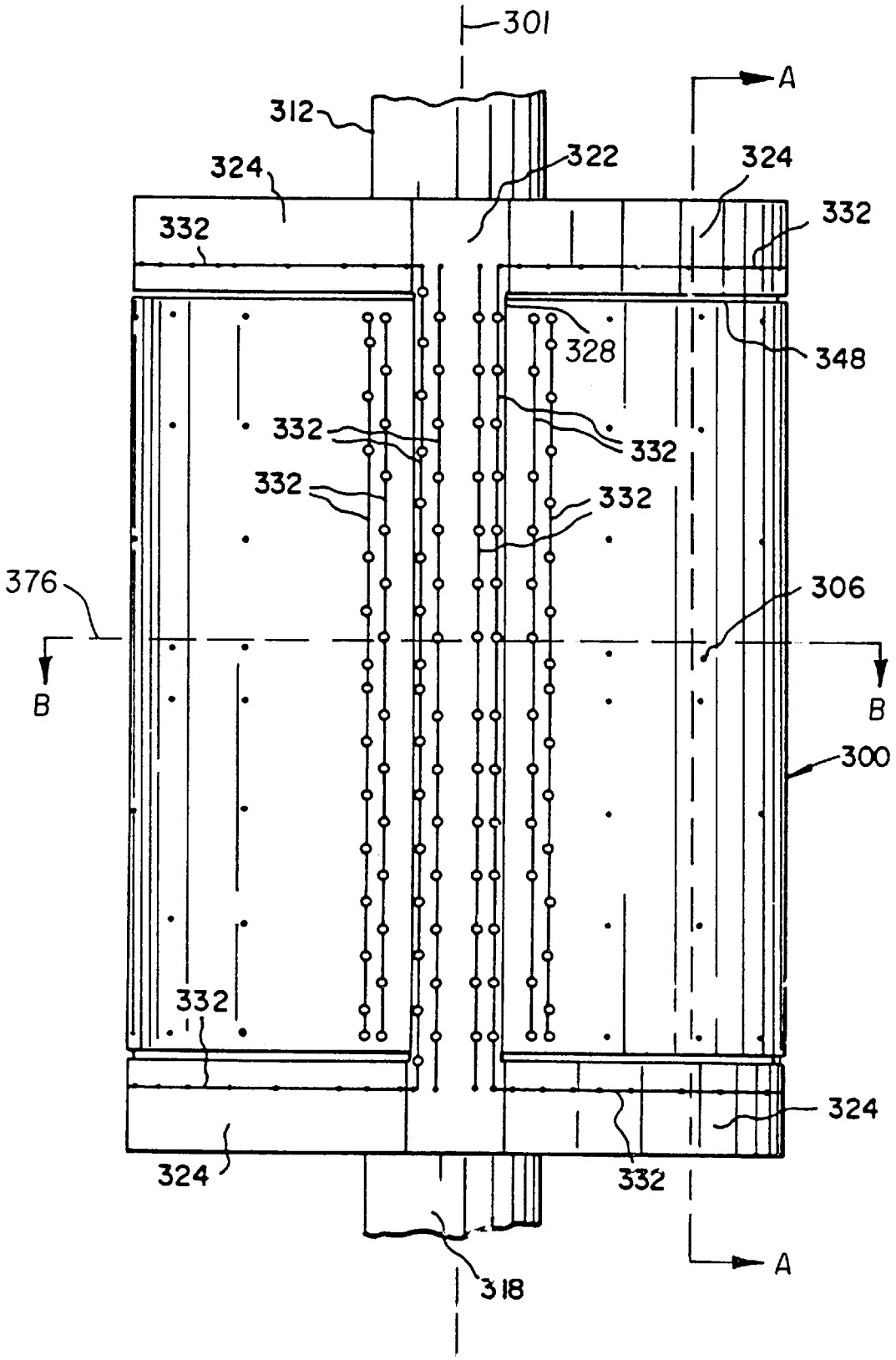
FIG. 4 is a plane view of the vacuum imaging drum surface of the present invention.
Figure 6:
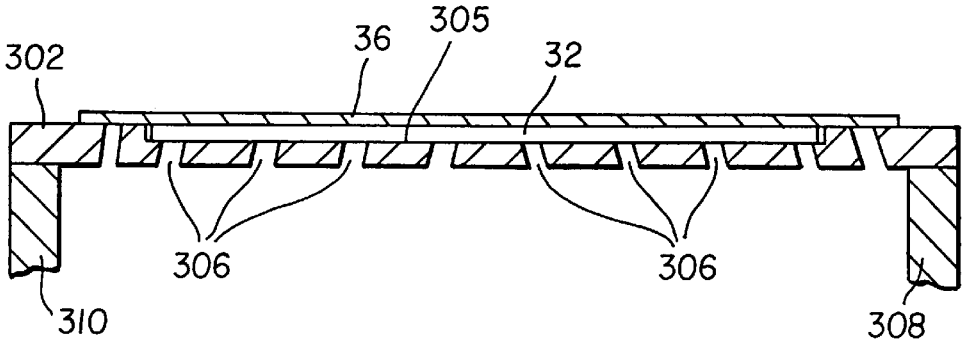
FIG. 6 is a side view in cross section of the outer shell of the vacuum imaging drum, shown in FIG. 4, taken through the drum in an axial direction along lines A—A.

FIG. 6 shows a cross-section view of a row of vacuum holes 306 taken from line A—A in FIG. 4. In order to grip the wrapped media securely and minimize any tendency for air entrapment, creases, folds, wrinkles, or other surface aberrations, vacuum holes 306 are drilled at an angle with respect to the surface of vacuum drum housing 302. As shown in FIG. 6, vacuum holes 306 are arranged at an acute angle, that is, less than 90°, relative to the surface 305 of the vacuum imaging drum 300 to apply vacuum force away from the centerline of thermal print media 32, and, correspondingly, away from the center of donor sheet media 36. In the preferred embodiment of this invention, a radial centerline 376 of cylindrical vacuum drum housing 302 is first identified. Then, vacuum holes 306 drilled in each half of vacuum imaging drum 300 are drilled at the same angle, with vacuum holes 306 in each half oriented toward the radial centerline 376.

Figure 7:
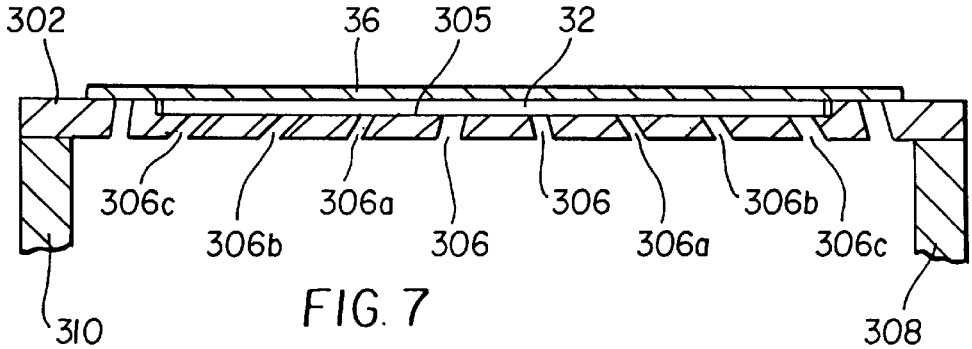
FIG. 7 is a side view in cross section of an alternate embodiment of the vacuum imaging drum, shown in FIG. 4, taken along lines A—A.

FIG. 7 shows an alternate embodiment of the invention, wherein angled vacuum holes 306 are drilled at increasingly acute angles as the distance of the vacuum hole from the radial centerline increases. For example, the angle of vacuum hole 306*a* with respect to the surface 305 of the vacuum imaging drum 300 is greater than the angle of 306. In a similar fashion, the angle of 306*b*, with respect to the surface 305 of the vacuum imaging drum 300 is greater than the angle of vacuum imaging hole 306*a*, the angle of 306*c* is greater than the angle of 306*b*.

Figure 8:
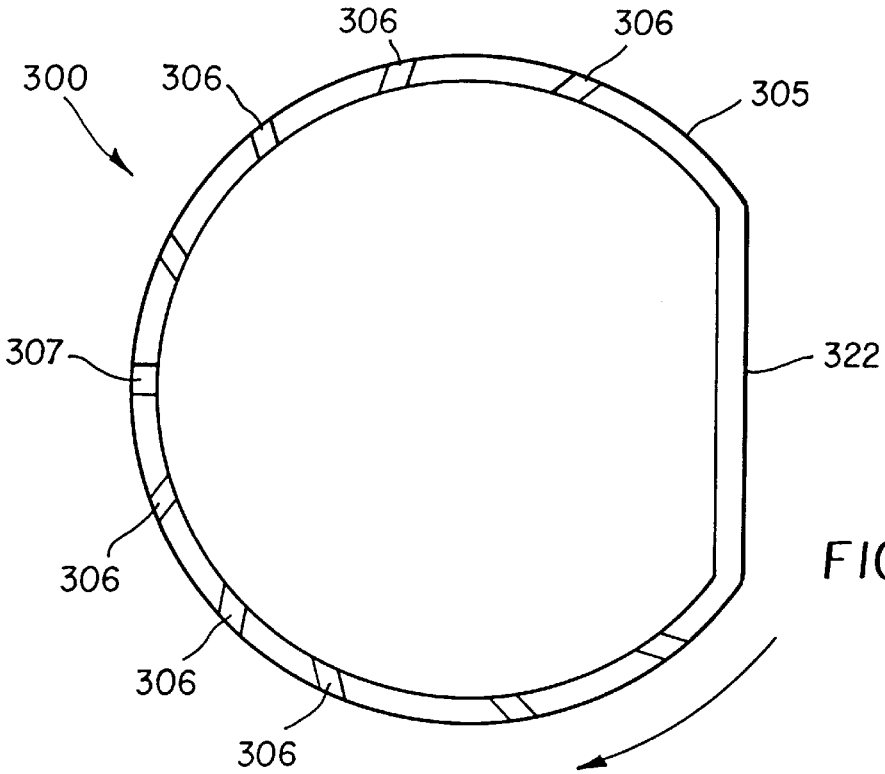
FIG. 8 is a side view in cross section of yet another embodiment of the vacuum imaging drum, shown in FIG. 4, along lines B—B.

In yet another embodiment, shown in FIG. 8, vacuum imaging holes 306 are drilled at acute angles to the surface 305 of vacuum imaging drum 300 so that vacuum holes 306 slant away from vacuum hole 307, which is located approximately opposite axially extending flat 322 at the mid-point, or axial centerline, of the thermal media loaded on vacuum imaging drum 300. The axial centerline is parallel to the axis of rotation 301. Slanting vacuum holes 306 in this fashion will tend to stretch the thermal media in a longitudinal direction to prevent creasing or wrinkling as the media is wrapped around the vacuum imaging drum 300 and rotated at high speeds.

The invention has been described with reference to the preferred embodiment thereof. However, it will be appreciated and understood that variations and modifications can be effected within the scope of the invention as described herein above and as defined in the appended claims by a person of ordinary skill in the art without departing from the scope of the invention. For example, the invention is applicable to vacuum imaging drums as well as to media transfer drums. Angles for vacuum holes 306 could be disposed differently. For example, while holes are typically drilled into the surface of a vacuum drum, holes could also be provided as part of a casting.

The invention has been described in detail with particular reference to certain preferred embodiments thereof, but it will be understood that variations and modifications can be effected within the scope of the invention. Although not described in detail it would be obvious to one skilled in the art that this invention could be used in other applications, including single sheet vacuum imaging drums, and other apparatus where it is desirable to hold and stretch a sheet of media. The media used in the invention is not limited to thermal print media, but also includes other media which may use dyes, inks, pigments and other materials.

PARTS LIST

10. Image processing apparatus
12. Image processor housing
14. Image processor door
16. Ejection chute
18. Waste bin
20. Media stop
32. Thermal print media
34. Donor roll material
36. Donor sheet material
50*a*. Lower sheet material tray
50*b*. Upper sheet material tray
52*a*. Lower media lift cam
52*b*. Upper media lift cam
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
200. Lathe bed scanning subsystem
202. Lathe bed scanning frame
204. Entrance passageway
206. Rear translation bearing rod
208. Front translation bearing rod
220. Translation stage member
250. Lead screw
254. Lead screw drive nut
256. Drive coupling
300. Vacuum imaging drum
301. Axis of rotation
302. Vacuum drum housing
304. Hollowed-out interior portion
305. Surface
306. Vacuum hole
308. Vacuum end plate
310. Drive end plate
312. Drive spindle
318. Vacuum spindle
320. Central vacuum opening

322. Axially extending flat
324. Donor support ring
326. Circumferential recess
328. Media contours
332. Vacuum grooves
376. Radial centerline
400. Laser assembly
402. Laser diode
404. Fiber optic cables
406. Distribution block
500. Printhead

What is claimed is:

1. An image processing apparatus comprising:

a vacuum imaging drum for holding thermal print media and dye donor material, in registration with said thermal print media, on a surface of said vacuum imaging drum;

a printhead for printing information to said thermal print media as said printhead is moved parallel to said surface of said vacuum imaging drum;

angled vacuum holes connecting said surface and an interior of said vacuum imaging drum to maintain said thermal print media on said surface wherein said angled holes are at an acute angle to said surface; and wherein said acute angle lies in a plane containing an axis of rotation of said vacuum imaging drum and which intersects said surface.

2. An image processing apparatus as in claim 1, wherein said acute angle varies based on a distance of each angled hole from a centerline of the drum.

3. An image processing apparatus as in claim 2, wherein said acute angle for each of said angled holes varies proportionately with said distance from said centerline.

4. An image processing apparatus as in claim 2, wherein said centerline is an axial centerline.

5. An image processing apparatus as in claim 2, wherein said centerline is a radial centerline.

6. An image processing apparatus comprising:

a vacuum imaging drum for holding thermal print media and dye donor material, in registration with said thermal print media, on a surface of said vacuum imaging drum;

a printhead for printing information to said thermal print media as said printhead is moved parallel to said surface of said vacuum imaging drum;

angled vacuum holes connecting said surface and an interior of said vacuum imaging drum to maintain said thermal print media on said surface wherein said angled holes are at an acute angle to said surface; and wherein said acute angle varies based on a distance of each angled hole from a centerline of the drum.

7. An image processing apparatus as in claim 6, wherein said acute angle for each of said angled holes varies proportionately with said distance from said centerline.

8. An image processing apparatus as in claim 6, wherein said centerline is an axial centerline.

9. An image processing apparatus as in claim 6, wherein said centerline is a radial centerline.

* * * * *